US010788181B1

(12) United States Patent
Gao et al.

(10) Patent No.: US 10,788,181 B1
(45) Date of Patent: Sep. 29, 2020

(54) LED AUTOMOBILE LAMP

(71) Applicant: Jiaxing Guangtai Lighting Co., Ltd., Jiaxing (CN)

(72) Inventors: Hui Gao, Jiaxing (CN); Haifeng Wan, Jiaxing (CN); Heming Liu, Jiaxing (CN); Huihui Guan, Jiaxing (CN); Kangkang Li, Jiaxing (CN); Cheng Yang, Jiaxing (CN)

(73) Assignee: JIAXING GUANGTAI LIGHTING CO., LTD., Jiaxing (CN)

( * ) Notice: Subject to any disclaimer, the term of this patent is extended or adjusted under 35 U.S.C. 154(b) by 0 days.

(21) Appl. No.: 16/735,731

(22) Filed: Jan. 7, 2020

(30) Foreign Application Priority Data

Sep. 20, 2019 (CN) ..... 2019 1 0892093

(51) Int. Cl.
*F21S 41/148* (2018.01)
*F21V 29/71* (2015.01)

(52) U.S. Cl.
CPC ..... *F21S 41/148* (2018.01); *F21V 29/713* (2015.01)

(58) Field of Classification Search
CPC ..... F21S 41/148; F21S 29/713
USPC ..... 362/516
See application file for complete search history.

(56) References Cited

U.S. PATENT DOCUMENTS

2003/0063476 A1* 4/2003 English ..... F21S 45/48 362/545
2003/0227774 A1* 12/2003 Martin ..... F21S 41/147 362/240
2005/0083686 A1* 4/2005 Yatsuda ..... F21S 41/148 362/230
2009/0080211 A1* 3/2009 Yasuda ..... F21S 45/435 362/547
2009/0097247 A1* 4/2009 Tseng ..... F21S 41/148 362/241
2010/0208480 A1* 8/2010 Matsunaga ..... F21V 29/71 362/509
2011/0280030 A1* 11/2011 Iwasaki ..... F21S 41/336 362/519
2012/0086322 A1* 4/2012 Lan ..... F21V 29/777 313/46
2012/0120652 A1* 5/2012 Bolander, Jr. ..... G02B 19/0023 362/235
2012/0201043 A1* 8/2012 DiPenti ..... F21S 41/39 362/545

(Continued)

*Primary Examiner* — Bryon T Gyllstrom

(74) *Attorney, Agent, or Firm* — Bayramoglu Law Offices LLC

(57) ABSTRACT

An LED automobile lamp includes a lens, a heat dissipation shell, a light source pillar, and a rear cover. The heat dissipation shell is mounted with a light-reflecting surface, the light source pillar is mounted at the bottom of the heat dissipation shell, the lens is arranged at the top of the heat dissipation shell, and the rear cover is arranged at the bottom of the light source pillar. A first light source plate and a second light source plate are symmetrically arranged on two sides of the light source pillar. Both the first light source plate and the second light source plate extend into a light-reflecting region surrounded by the light-reflecting surface and the lens. The top of the light source pillar is provided with a light-shielding sheet, and a bottom of the light source pillar is provided with a stepped plane coupling with the heat dissipation shell.

9 Claims, 4 Drawing Sheets

(56) References Cited

U.S. PATENT DOCUMENTS

| | | | | |
|---|---|---|---|---|
| 2013/0107564 | A1* | 5/2013 | Yatsuda | F21S 45/48<br>362/543 |
| 2013/0135886 | A1* | 5/2013 | Tanaka | F21S 41/663<br>362/516 |
| 2013/0215632 | A1* | 8/2013 | Jackl | F21S 45/49<br>362/514 |

* cited by examiner

LED AUTOMOBILE LAMP

CROSS REFERENCE TO THE RELATED APPLICATIONS

This application is based upon and claims priority to Chinese Patent Application No. 2019108920936, filed on Sep. 20, 2019, the entire contents of which are incorporated herein by reference.

TECHNICAL FIELD

The present disclosure relates to the technical field of electric light source, and more particularly, to an LED automobile lamp.

BACKGROUND

Currently, LED automobile lamps generally have the following disadvantages.

1. During the product assembly processes, homogeneity of an LED automobile lamp is poor due to fitting installation errors. A large proportion of mass-produced automobile lamps cannot meet regulatory requirements, and a necessary percentage of automobile lamps passing inspection cannot be guaranteed unless a full product inspection and a subsequent calibration are made.
2. High luminous efficacy, long service life and high reliability of the LED, can all be expected in theory, however, these features are not guaranteed in practice and the LED may even display early failure because of a poor design for thermal conduction and poor reliability of the LED.
3. An unreasonable, incompetent or insufficient heat dissipation design may lead to adverse consequences regarding the operating junction temperature of the LED that may reach beyond a safe temperature range. High luminous efficacy, long service life, and high reliability of the LED which are possible to achieve in theory, cannot be guaranteed and even early failure of the LED is possible in practice.
4. The light distribution of the LED cannot meet the regulatory requirements, and the lighting safety and comfort expected from an operational LED automobile lamp cannot be guaranteed because of the LED structural design not being an optically sound design, or having a light distribution design method that is not reasonable.

SUMMARY

An objective of the present disclosure is to solve the problems in the prior art by providing an LED automobile lamp, which can ensure homogeneity of mass-produced products and has a high luminous efficacy, long service life, and high reliability.

To achieve the above objective, the present disclosure provides an LED automobile lamp, that includes a lens, a heat dissipation shell, a light source pillar, and a rear cover. The heat dissipation shell is internally mounted with a light-reflecting surface, the light source pillar is installed at the bottom of the heat dissipation shell, the lens is mounted at the top of the heat dissipation shell, and the rear cover is mounted at the bottom of the light source pillar. A first light source plate and a second light source plate are symmetrically mounted on two sides of the light source pillar. Both the first light source plate and the second light source plate extend into a light-reflecting region surrounded by the light-reflecting surface and the lens. The top of the light source pillar is provided with a light-shielding sheet, and the bottom of the light source pillar is provided with a stepped plane closely coupling with the heat dissipation shell.

Preferably, the light source pillar is tightly fastened to the heat dissipation shell by a plurality of screws, and the light source pillar further includes a fixed pillar body and a stepped limit dais. Two sides of the fixed pillar body are symmetrically provided with flat mounting surfaces for fixing the first light source plate and the second light source plate. A plurality of second mounting holes are uniformly arranged on the flat mounting surface. The light-shielding sheet is arranged on the top of the fixed pillar body, the stepped limit dais is arranged on the bottom of the fixed pillar body, and the stepped plane is arranged on the end face where the stepped limit dais is connected to the fixed pillar body.

Preferably, the bottom of the heat dissipation shell is provided with a cylindrical boss, wherein the cylindrical boss is internally provided with a stepped circular hole fitting with the light source pillar. A plurality of guide positioning grooves with different sizes are arranged at intervals in a circumferential direction of the stepped limit dais, and the stepped circular hole of the cylindrical boss is internally provided with a plurality of guided anti-deviation ribs protruding inwardly and fitting together with the guide positioning grooves.

Preferably, the light-reflecting surface is an integrated structure or a combined structure.

Preferably, the light-reflecting surface is composed of two semi-light-reflecting surfaces and a transition surface connected between the two semi-light-reflecting surfaces. The two semi-light-reflecting surfaces are respectively arranged in correspondence with the first light source plate and the second light source plate. The focus of each of the two semi-light-reflecting surfaces is located on the surface of the corresponding light source plate. The transition surface does not participate in light distribution.

Preferably, the outer surface of the heat dissipation shell is provided with a heat dissipation fin, the heat dissipation fin is consistent with a vertical mounting direction of the automobile lamp, and the heat dissipation shell is made of aluminum alloy material.

Preferably, the light-reflecting surface is arranged on a concave surface of a light-reflecting component, and a support hem is extended on an outer periphery of the light-reflecting component. A plurality of fixed mounting studs is arranged at intervals in the heat dissipation shell, and the support hem is provided with first mounting holes corresponding to the fixed mounting studs.

Preferably, the rear cover is tightly fastened to the cylindrical boss at the bottom of the heat dissipation shell by screws, the rear cover is provided with an integrally-injected power copper pin, the rear cover is internally provided with a round hole for potting, and the rear cover is also provided with a nylon rivet for hole sealing.

Preferably, when the light-reflecting surface independently distributes light, the lens is a flat transparent lens; and when the light-reflecting surface distributes light in combination with the lens, the lens is a pattern lens.

Preferably, a cross-sectional shape of the light-reflecting surface is approximate to a circle or a rectangle. When the cross-sectional shape of the light-reflecting surface is a rectangle, an auxiliary light-shielding sheet is also arranged at an end of the light source pillar, and an end of the auxiliary light-shielding sheet has a light-shielding hem extending toward the light source plate.

The advantages of the present disclosure are listed below. The present disclosure provides a new-type of LED automobile lamp structure and a light distribution design to eliminate installation error of attachments and ensure homogeneity of mass-produced products. Based on an optimized design of heat conduction and heat dissipation, it is ensured that an operating junction temperature of the LED is relatively low and within a safe range, and it is ensured that the LED automobile lamp has a theoretically high luminous efficacy, long service life, and highly reliable. The light distribution design combined with a structural design can simplify the light distribution design and make it easier to comply with regulatory requirements so as to ensure the safety and comfort of automobile lamp lighting.

Features and advantages of the present disclosure will be described in detail through embodiments with reference to accompanying drawings.

DETAILED DESCRIPTION OF THE EMBODIMENTS

Embodiment 1

Figure 1:
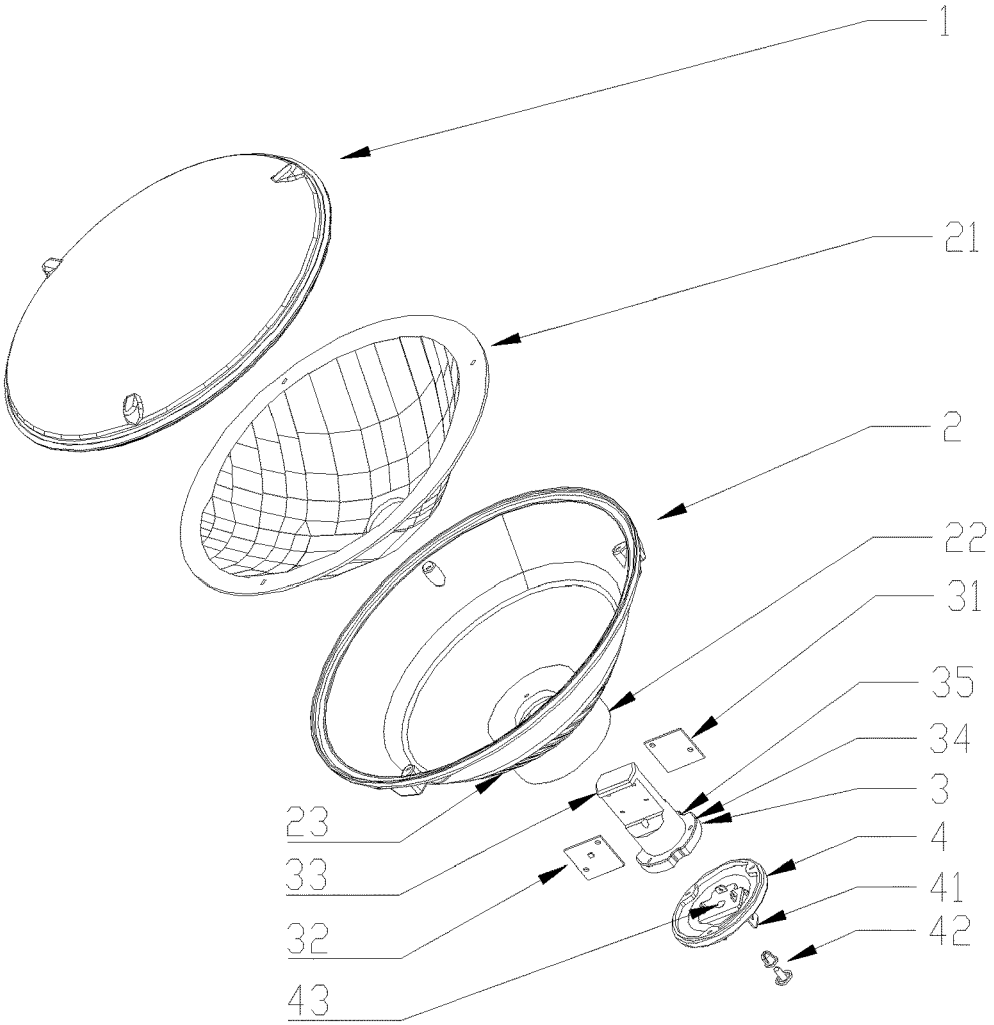
FIG. 1 is an exploded view of the LED automobile lamp according to Embodiment 1 of the present disclosure.

Referring to FIG. 1, an LED automobile lamp of the present disclosure includes the lens 1, the heat dissipation shell 2, the light source pillar 3, and the rear cover 4. The heat dissipation shell 2 is internally mounted with the light-reflecting surface 21, the light source pillar 3 is mounted at the bottom of the heat dissipation shell 2, the lens 1 is installed at the top of the heat dissipation shell 2, and the rear cover 4 is mounted at the bottom of the light source pillar 3. The first light source plate 31 and the second light source plate 32 are symmetrically mounted on two sides of the light source pillar 3. Both the first light source plate 31 and the second light source plate 32 extend into the light-reflecting region surrounded by the light-reflecting surface 21 and the lens 1. The top of the light source pillar 3 is provided with the light-shielding sheet 33, and the bottom of the light source pillar 3 is provided with the stepped plane 34 closely coupling with the heat dissipation shell 2.

Figure 3:
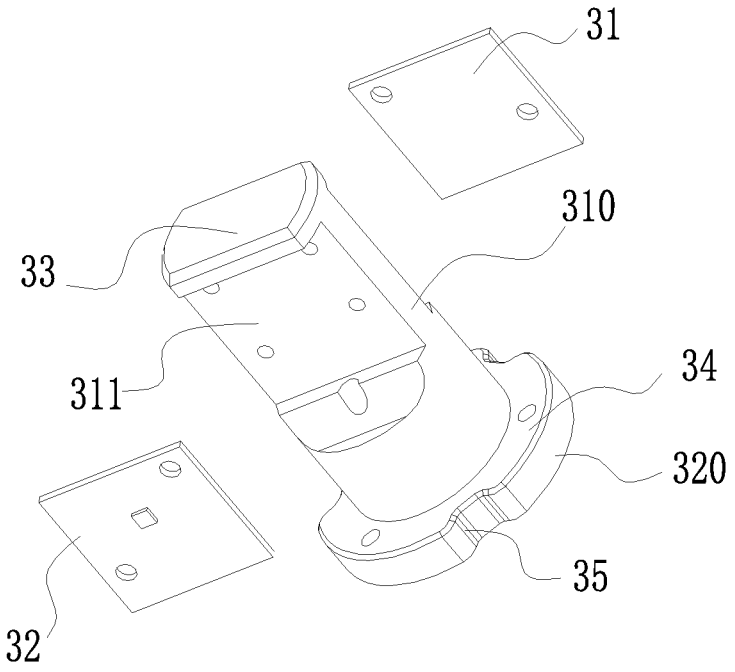
FIG. 3 is an exploded view of the light source pillar of the LED automobile lamp according to Embodiment 1 of the present disclosure.

Further, referring to FIG. 3, the light source pillar 3 is tightly fastened to the heat dissipation shell 2 by a plurality of screws, and the light source pillar 3 further includes the fixed pillar body 310 and the stepped limit dais 320. Two sides of the fixed pillar body 310 are symmetrically provided with flat mounting surfaces 311 for fixing the first light source plate 31 and the second light source plate 32. A plurality of second mounting holes are uniformly arranged on the flat mounting surface 311. The light-shielding sheet 33 is arranged on the top of the fixed pillar body 310 to prevent the LED from directly emitting light.

Further, referring to FIG. 3, the stepped limit dais 320 is arranged on the bottom of the fixed pillar body 310, and the stepped plane 34 is arranged on the end face where the stepped limit dais 320 is connected to the fixed pillar body 310. The bottom of the heat dissipation shell 2 is provided with the cylindrical boss 22, wherein the cylindrical boss 22 is internally provided with a stepped circular hole fitting with the light source pillar 3. Three guide positioning grooves 35 with different sizes are arranged at intervals in a circumferential direction of the stepped limit dais 320, and the stepped circular hole of the cylindrical boss 22 is internally provided with a plurality of guided anti-deviation ribs protruding inwardly and fitting with the guide positioning grooves 35. This structure can prevent the light source pillar 3 from being mounted upside down or being mounted on a bias, and can ensure homogeneity of mass-produced products.

Figure 2:
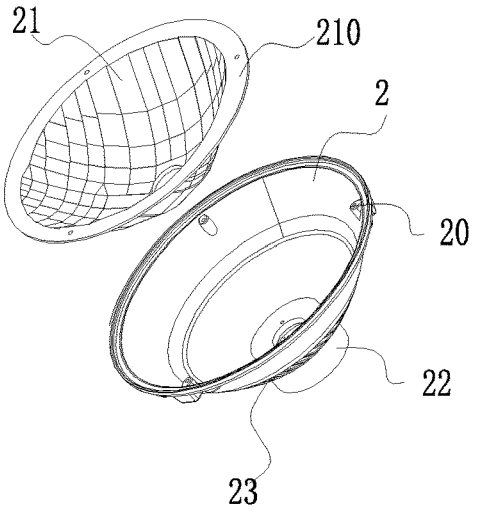
FIG. 2 is an exploded view of the heat dissipation shell of the LED automobile lamp according to Embodiment 1 of the present disclosure.

Further, referring to FIG. 2, as a combined structure, the light-reflecting surface 21 is composed of two semi-light-reflecting surfaces and a transition surface connected between the two semi-light-reflecting surfaces. The two semi-light-reflecting surfaces are respectively arranged by corresponding to the first light source plate 31 and the second light source plate 32, and the focus of each of the two semi-light-reflecting surfaces is located on the surface of the corresponding light source plate. The transition surface does not participate in the light distribution.

Further, the outer surface of the heat dissipation shell 2 is provided with the heat dissipation fin 23, and the heat dissipation fin 23 is distributed in a direction perpendicular to the direction in which the automobile lamp is mounted. The heat dissipation shell 2 is made of aluminum alloy material, and thus has a good thermal conductivity.

Further, the light-reflecting surface 21 is arranged on a concave surface of a light-reflecting component, and the support hem 210 is extended on the outer periphery of the light-reflecting component. A plurality of fixed mounting studs 20 are arranged at intervals in the heat dissipation shell 2, and the support hem 210 is provided with first mounting holes corresponding to the fixed mounting studs 20, facilitating installation and fixation.

Figure 4:
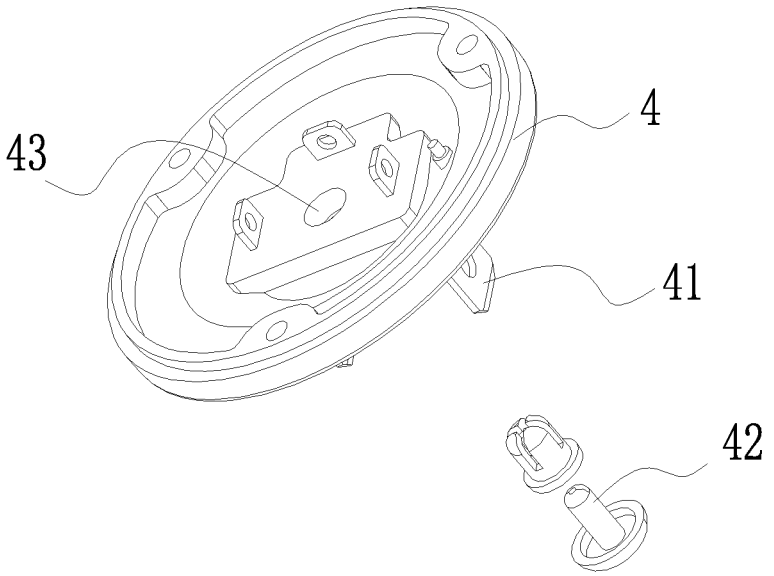
FIG. 4 is an exploded view of the rear cover of the LED automobile lamp according to Embodiment 1 of the present disclosure.

Further, referring to FIG. 4, the rear cover 4 is tightly fastened to the cylindrical boss 22 at the bottom of the heat dissipation shell 2 by screws, the rear cover 4 is provided with the integrally-injected power copper pin 41, the rear cover 4 is internally provided with the round hole 43 for potting thermally conductive waterproof glue, and the rear cover 4 is also provided with the nylon rivet 42 for hole sealing upon completion of glue potting.

Furthermore, when a cross-sectional shape of the light-reflecting surface 21 is a circle, and when the light-reflecting surface 21 independently distributes light, a flat transparent lens is selected as the lens 1.

Embodiment 2

Figure 5:
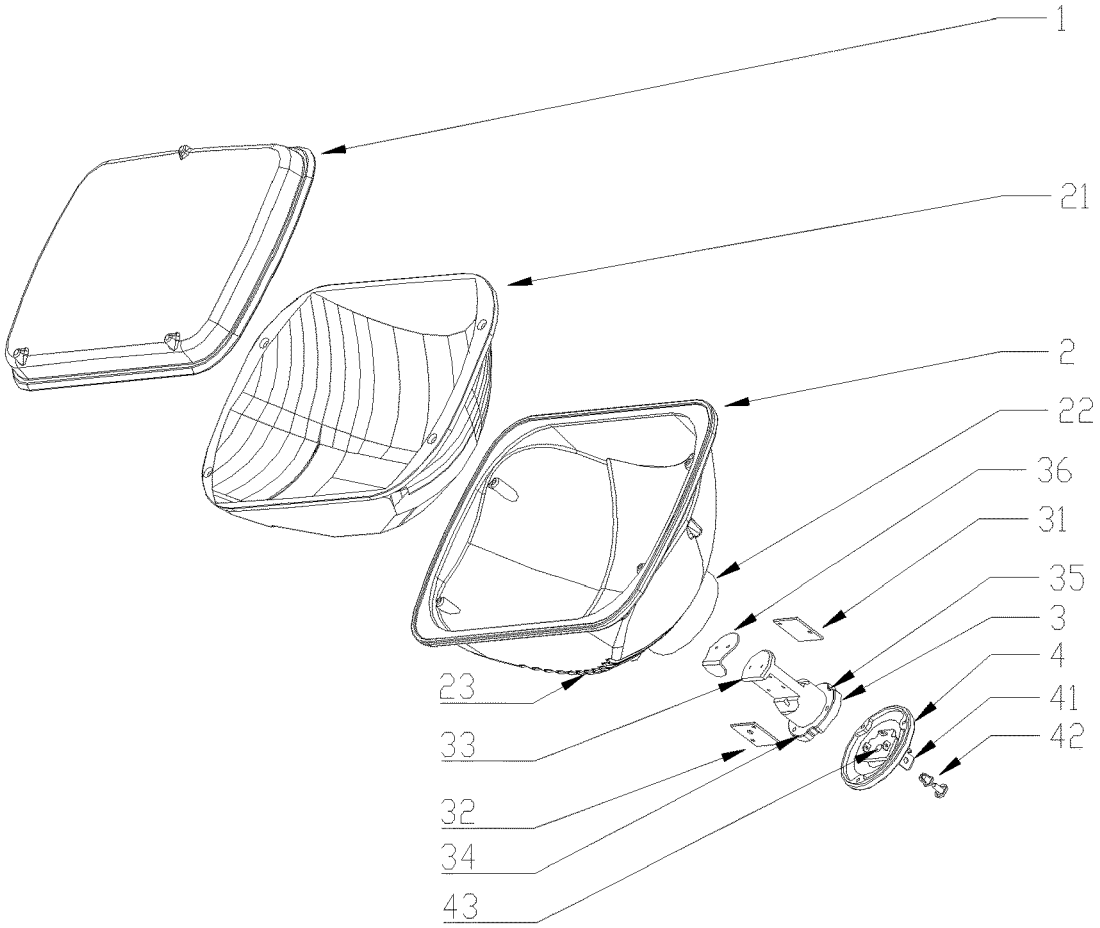
FIG. 5 is an exploded view of the LED automobile lamp according to Embodiment 2 of the present disclosure.
Figure 6:
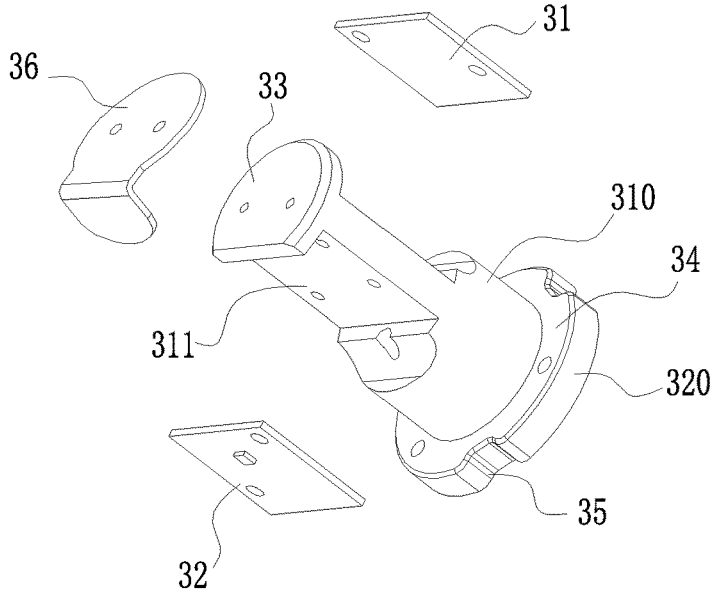
FIG. 6 is an exploded view of the light source pillar of the LED automobile lamp according to Embodiment 2 of the present disclosure.

Referring to FIG. 5 and FIG. 6, the differences between the present embodiment and Embodiment 1 are that the cross-sectional shape of the light-reflecting surface 21 is approximate to a rectangle, the auxiliary light-shielding sheet 36 is also arranged at an end of the light source pillar 3, and an end of the auxiliary light-shielding sheet 36 has a light-shielding hem extending toward the light source plate, wherein the auxiliary light-shielding sheet 36 is mounted in a direction where a light-shielding portion is down from the mounting location of the automobile lamp.

Embodiment 3

Figure 7:
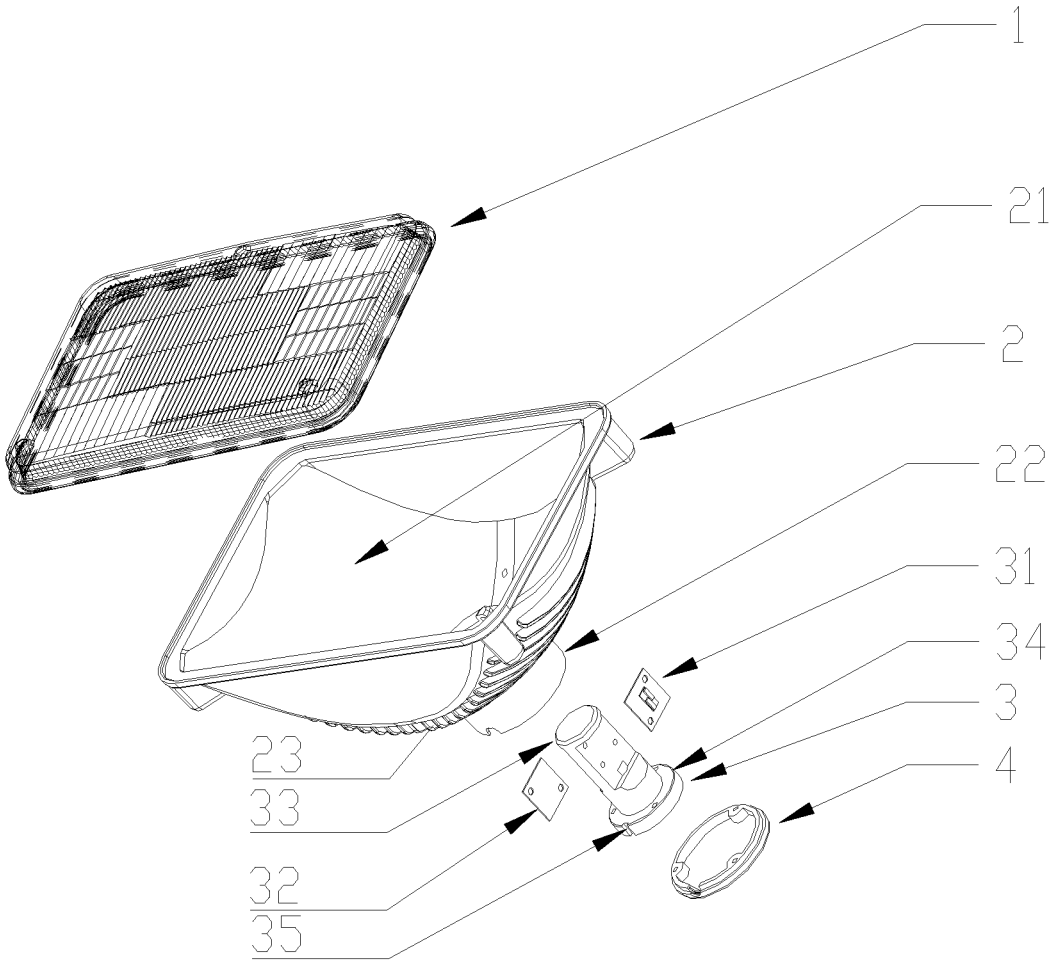
FIG. 7 is an exploded view of the LED automobile lamp according to Embodiment 3 of the present disclosure.

Referring to FIG. 7, the differences between the present embodiment and Embodiment 1 are that the cross-sectional shape of the light-reflecting surface 21 is approximate to a rectangle, the light-reflecting surface 21 adopts an integrated structure, the light-reflecting surface 21 distributes light in combination with lens 1, and a pattern lens is selected as lens 1.

The above embodiments are for illustrating the present disclosure rather than limiting the present disclosure, and any solution obtained by simply modifying the present disclosure shall fall within the scope of protection of the present disclosure.

What is claimed is:

1. An LED automobile lamp, comprising:

a lens, a heat dissipation shell, a light source pillar, and a rear cover;

wherein the heat dissipation shell is internally mounted with a light-reflecting surface, the light source pillar is arranged at a bottom of the heat dissipation shell, the lens is arranged at a top of the heat dissipation shell, the rear cover is arranged at a bottom of the light source pillar, a first light source plate and a second light source plate are symmetrically arranged on two sides of the light source pillar, both the first light source plate and the second light source plate extend into a light-reflecting region, the light-reflecting region is surrounded by the light-reflecting surface and the lens, a top of the light source pillar is provided with a light-shielding sheet, and the bottom of the light source pillar is provided with a stepped plane, the stepped plane is coupled with the heat dissipation shell, wherein the light source pillar is fastened to the heat dissipation shell by a plurality of screws, and the light source pillar further comprises a fixed pillar body and a stepped limit dais, wherein two sides of the fixed pillar body are symmetrically provided with flat mounting surfaces for fixing the first light source plate and the second light source plate, a plurality of second mounting holes are uniformly arranged on the flat mounting surfaces, the light-shielding sheet is arranged on a top of the fixed pillar body, the stepped limit dais is arranged on a bottom of the fixed pillar body, and the stepped plane is arranged on an end face and the stepped limit dais is connected to the fixed pillar body on the end face.

2. The LED automobile lamp according to claim 1, wherein the bottom of the heat dissipation shell is provided with a cylindrical boss, the cylindrical boss is internally provided with a stepped circular hole fitting with the light source pillar, a plurality of guide positioning grooves with different sizes are arranged at intervals in a circumferential direction of the stepped limit dais, and the stepped circular hole of the cylindrical boss is internally provided with a plurality of guided anti-deviation ribs, and the plurality of guided anti-deviation ribs protrude inwardly and are fitted within the plurality of guide positioning grooves.

3. The LED automobile lamp according to claim 1, wherein the light-reflecting surface is an integrated structure or a combined structure.

4. The LED automobile lamp according to claim 1, wherein the light-reflecting surface is composed of two semi-light-reflecting surfaces and a transition surface, the transition surface is connected between the two semi-light-reflecting surfaces, the two semi-light-reflecting surfaces are respectively arranged in correspondence with the first light source plate and the second light source plate, and a focus of each of the two semi-light-reflecting surfaces is located on a surface of the corresponding light source plate, and the transition surface does not participate in a light distribution.

5. The LED automobile lamp according to claim 1, wherein an outer surface of the heat dissipation shell is provided with a heat dissipation fin, the heat dissipation fin is distributed in a direction perpendicular to a mounting direction of the automobile lamp, and the heat dissipation shell is made of aluminum alloy material.

6. The LED automobile lamp according to claim 1, wherein the light-reflecting surface is arranged on a concave surface of a light-reflecting component, a support hem is extended on an outer periphery of the light-reflecting component, a plurality of fixed mounting studs are arranged at intervals in the heat dissipation shell, and the support hem is provided with a plurality of first mounting holes corresponding to the plurality of fixed mounting studs.

7. The LED automobile lamp according to claim 1, wherein the rear cover is fastened to a cylindrical boss by the plurality of screws, the cylindrical boss is at the bottom of the heat dissipation shell, the rear cover is provided with an integrally-injected power copper pin, the rear cover is internally provided with a round hole for potting, and the rear cover is further provided with a nylon rivet for a hole sealing.

8. The LED automobile lamp according to claim 1, wherein when the light-reflecting surface distributes light, the lens is a flat transparent lens, and when the light-reflecting surface distributes light in combination with the lens, the lens is a pattern lens.

9. The LED automobile lamp according to claim 1, wherein a cross-sectional shape of the light-reflecting surface is a circle or a rectangle, when the cross-sectional shape of the light-reflecting surface is the rectangle, an auxiliary light-shielding sheet is also arranged at an end of the light source pillar, and an end of the auxiliary light-shielding sheet has a light-shielding hem extending toward the light source plate.

* * * * *